United States Patent [19]

Ram

[11] 4,053,987

[45] Oct. 18, 1977

[54] MULTI-PURPOSE DRAWING INSTRUMENT

[76] Inventor: Mayya Narayan Ram, 8th Dwarka Kunj, Plot 509, 12th Road, Chembur, Bombay 400 071 AS, Maharashtra, India

[21] Appl. No.: 715,208

[22] Filed: Aug. 17, 1976

[51] Int. Cl.[2] ..... B43L 13/24

[52] U.S. Cl. ..... 33/81

[58] Field of Search ..... 33/81, 110, 77, 80, 33/76 R

[56] References Cited

U.S. PATENT DOCUMENTS

| | | | |
|---|---|---|---|
| 1,469,192 | 9/1923 | Shepard | 33/110 |
| 1,980,884 | 11/1934 | Sidney | 33/110 |

*Primary Examiner*—Harry N. Haroian

[57] ABSTRACT

A multi-purpose drawing instrument comprising a guide rod supported horizontally on upright end supports and slidably engaging a roller support on a slide disc such that the disc is slidable along the rod. A carriage is slidingly supported on the guide rod above the slide disc and carries a conical member whose side wall is in pressure contact with the guide rod such that when the conical member is turned the carriage moves along the guide rod. The position of the carriage transversely of the guide rod can be adjusted and the carriage can be engaged with the slide disc when the carriage or slide disc is moved along the guide rod. A horizontally-disposed radial arm is rotatably connected to the center of the slide disc and it has a free end connectable to a ruler. The arm is capable of being clamped to the slide disc at any desired angle relative to the guide rod or carriage.

12 Claims, 13 Drawing Figures

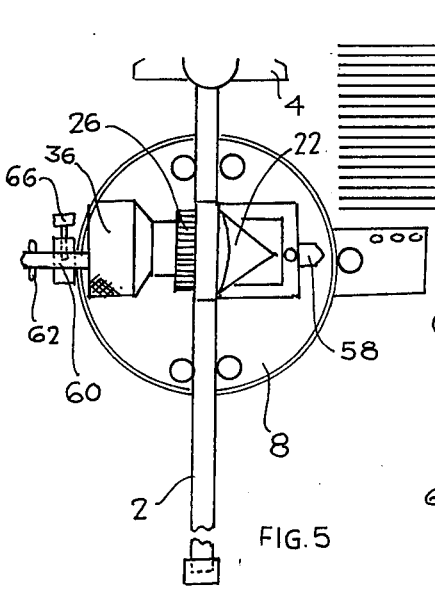
FIG. 5
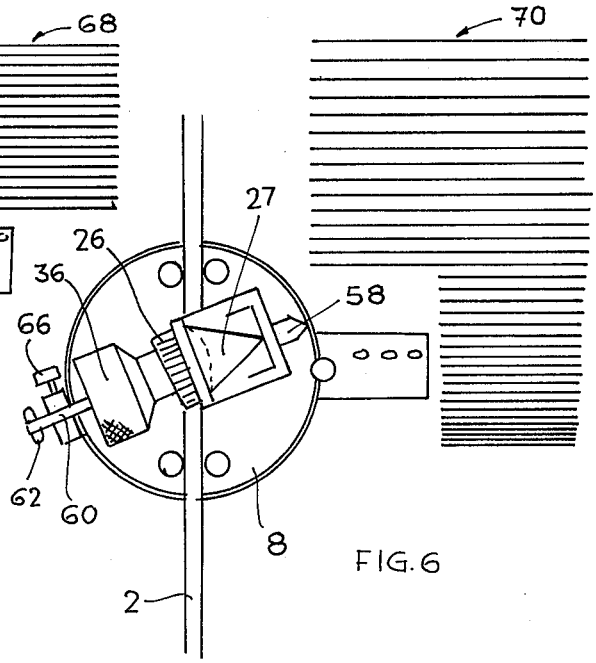
FIG. 6
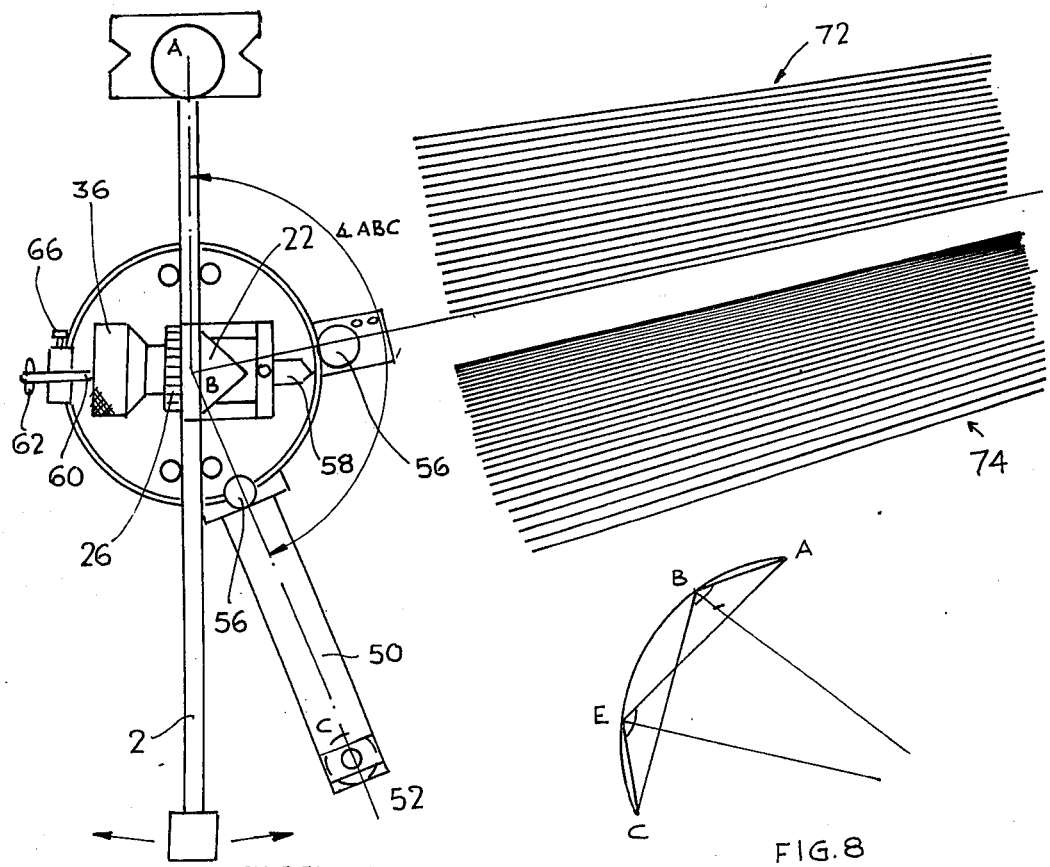
FIG. 7
FIG. 8

MULTI-PURPOSE DRAWING INSTRUMENT

This invention relates to a multi-purpose drawing instrument and has as one of its objects to provide a drawing instrument which can be employed in a simple manner to draw parallel and equidistant lines, increasing and decreasing shade lines, vanishing lines and vanishing lines in perspective.

Another object is to provide a drawing instrument which is accurate and fast to work with.

Accordingly, this invention provides a multi-purpose drawing instrument comprising a guide rod supported horizontally on upright end supports; a slide disc provided with roller support means which slidingly engages said guide rod so that the disc slides along said guide rod; a carriage slidingly supported on said guide rod above said slide disc and carrying a conical member with the side wall thereof in pressure contact with the guide rod so that when said conical member is turned the carriage moves along the guide rod, tightening means on said carriage for varying the contact pressure of the conical member on the guide rod; adjustment means for adjusting the position of the carriage transversely of said guide rod and for engaging the carriage with the slide disc when said carrage or slide disc is moved along the guide rod; a horizontally-disposed radial arm one end of which is rotatably connected to the center of the slide disc so that it can be rotated thereat and the free end of which is connectable to a foot ruler, means for clamping and clamping/said horizontally disposed radial arm to said slide disc at any desired angle relative to the guide rod or said carriage.

Preferably, said conical member may be provided with a manually operable toothed wheel at one end thereof and said carriage may be provided with an abutment means which engages the toothed wheel so that when said conical member is turned through a distance equal to that between two adjacent teeth the carriage travels along said guide rod by an identical distance. Preferably, said abutment means may be adjustably mounted on the carriage and a release mechanism may be provided in the vicinity thereof on the carriage for moving said abutment means to engage or disengage the toothed wheel. The abutment means may comprise a roller.

For facilitating the operation of said conical member, a knurled head may be provided on said toothed wheel on the side thereof remote from said conical member.

In one embodiment of the invention, said slide disc may be located below said guide rod and said carriage may comprise a base plate disposed over said slide disc; a pair of oppositely-disposed upright shoulders mounted on said base plate and connected by a pair of roller rods disposed below and substantially transversely of said guide rod, said roller rods being in pressure contact with said guide rod; and an enclosure supported on said pair of upright shoulders for housing said conical member and for supporting said toothed wheel, said enclosure being disposed above said guide rod and having an open base to allow the sidewall of said conical member to press against said guide rod.

Preferably, said tightening means may comprise at least one screw provided at one end of the enclosure, which screw engages a corresponding aperture in said oppositely-disposed upright shoulder.

Preferably, said adjustment means may comprise an extended slot provided in said base plate and disposed transversely of said guide rod and an upright engagement lug or pin located centrally in said slide disc and projecting within said extended slot so that said carriage can be moved transversely of said guide rod.

In another embodiment, a horizontally-disposed index rod may be adjustably mounted at the periphery of said slide disc with one end of said index rod abutting one of the said upright shoulders to enable the transverse position of said carriage relative to said guide rod to be set precisely.

In another embodiment, said instrument may include an additional horizontally-disposed radial arm one end of which is rotatably connected to the center of the slide disc so that it can be rotated thereat and the other end or free end of which is provided with guide channels for slidably locating a ruler, clamping means being provided for clamping said additional radial arm to said slide disc at any desired angle relative to the guide rod or said carriage.

In yet another embodiment the slide ruler locatable in the other end of the additional radial arm is provided with a pin-hole.

In another embodiment, said slide disc may be a protractor, a pointer being mounted between said disc and said carriage so as to indicate the angular position of the carriage relative to the guide rod.

In another embodiment one of said upright end support may be provided with a supporting pin and/or roller bearings.

An embodiment of the invention will now be described, by way of example, with reference to the accompanying drawings, in which FIG. 1 shows a perspective view of the multi-purpose drawing instrument from one side thereof;

FIG. 5 shows a plan view of the drawing instrument arranged for drawing equidistant lines;

FIG. 6 shows a plan view of the drawing instrument arranged for drawing increasing and decreasing shade lines;

FIG. 7 shows a plan view of the instrument arranged for drawing vanishing lines;

FIG. 8 is a diagram explaining the generation of vanishing lines;

Figure 12:
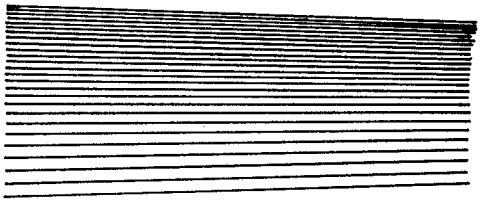
Figure 13:
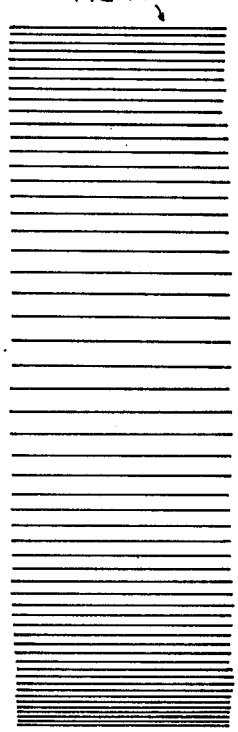
Figure 13:
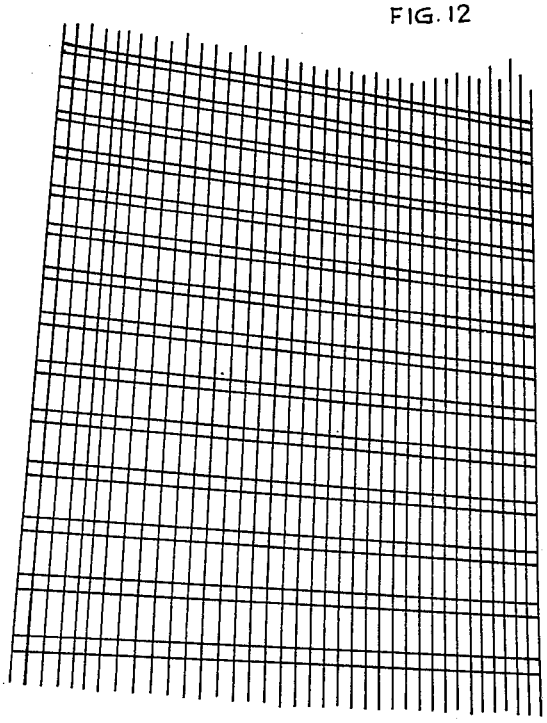

FIGS. 12 and 13 each show different patterns of vanishing lines in perspective generated by said instrument.

Figure 1:
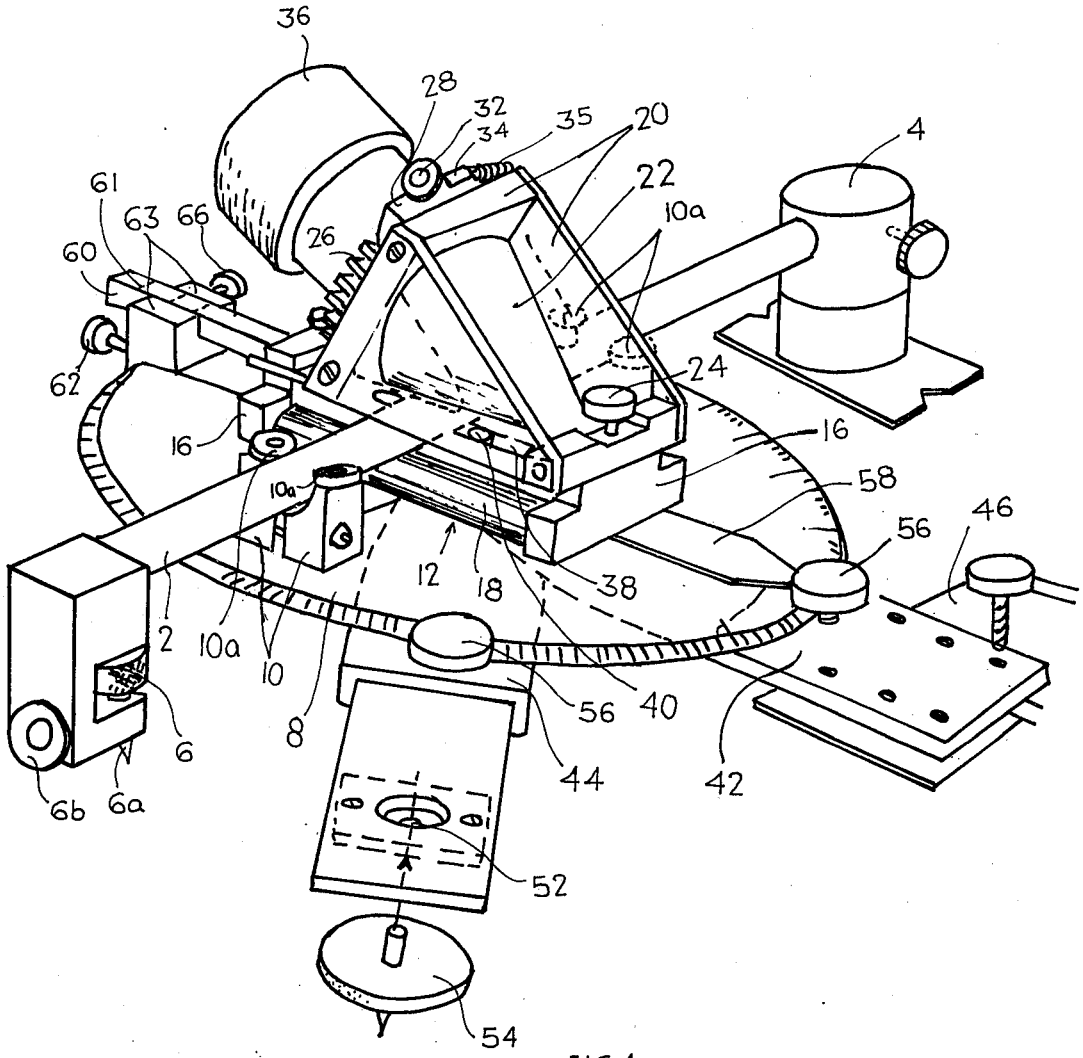

Referring to FIG. 1, the multi-purpose drawing instrument consists of a guide rod 2 supported horizontally on a pair of upright end supports 4 and 6, of which end support 4 has a fixed non-rotating base and a rotatable top part. The end support 6 has a pin 6*a* which when screwed down fixedly locates the end support 6 or when unscrewed allows the end support 6 to freely roll on rollers 6*b* and the guide rod to turn about fixed end support 4.

Figure 4:
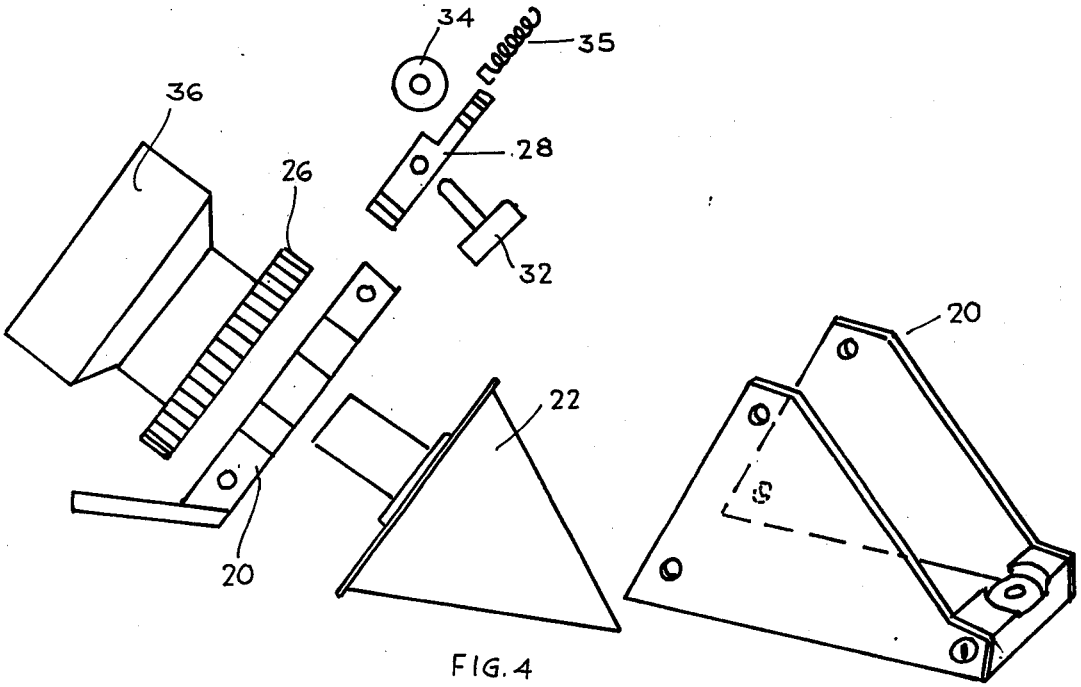
FIG. 4 shows an exploded view of the conical member seen in FIGS. 1 and 2.

The guide rod 2 carries a slide disc 8, which slide disc in the embodiment shown, is a circular protractor; this slide disc can slide along the guide rod on roller supports 10 (reference numeral 10*a* indicates the rollers provided for this purpose). Above the slide disc 8 is provided a carriage, generally denoted by reference numeral 12, which carriage is also slidingly mounted on said guide rod 2. The carriage 12 consists of a base plate 14 disposed over said slide disc 8, a pair of oppositely-disposed upright shoulders 16 mounted on the base plate 14 and connected together by a pair of roller rods 18; the roller rods 18 extend substantially transversely of and below said guide rod 2. The carriage supports an enclosure 20 and a conical member 22 which is maintained in pressure contact on said guide rod 2 from above by means of tightening members such as screws 24 which clamp the enclosure 20 to the carriage 12 with the guide rod in pressure-egagement between said conical member 22 and the roller rods 18. The conical member 22 is connected to a toothed wheel 26, at one end thereof; this toothed wheel is supported on said enclosure 20 for rotating the conical member 22 through a distance corresponding to the gap between two adjacent teeth. An exploded view of the toothed wheel and conical member is shown in FIG. 4. A release mechanism comprising a spring-loaded lever 28 is provided in the vicinity of the teeth of the toothed wheel 26. The lever is operated by a screw 32 for moving the roller 34 (abutment means) close to the toothed wheel or away from it, in known manner, so as to abut the teeth or release the teeth. In the former case, the toothed wheel 26 will turn against the pressure of the roller 34 and it will thus be possible to know that the toothed wheel has turned through a distance equal to the gap between two adjacent teeth from a feel of the step-like movement generated by the travel of the roller over a tooth from one gap to the next under the tension of the spring 35. A knurled head 36 is provided for turning the toothed wheel 26.

The base plate 14 carries a slot 38 running transversely of said guide rod 2; this slot engages an upright pin 40 (FIG. 1) in the longitudinal direction so that the carriage 12 can be moved transversely of said guide rod 2 and relative to said slide disc 8. The upright pin 40 is provided axially on the slide disc 8 and serves also to carry the carriage 12 along with the slide disc 8 when either the carriage or the slide disc is moved along the guide rod 2.

Figure 2:
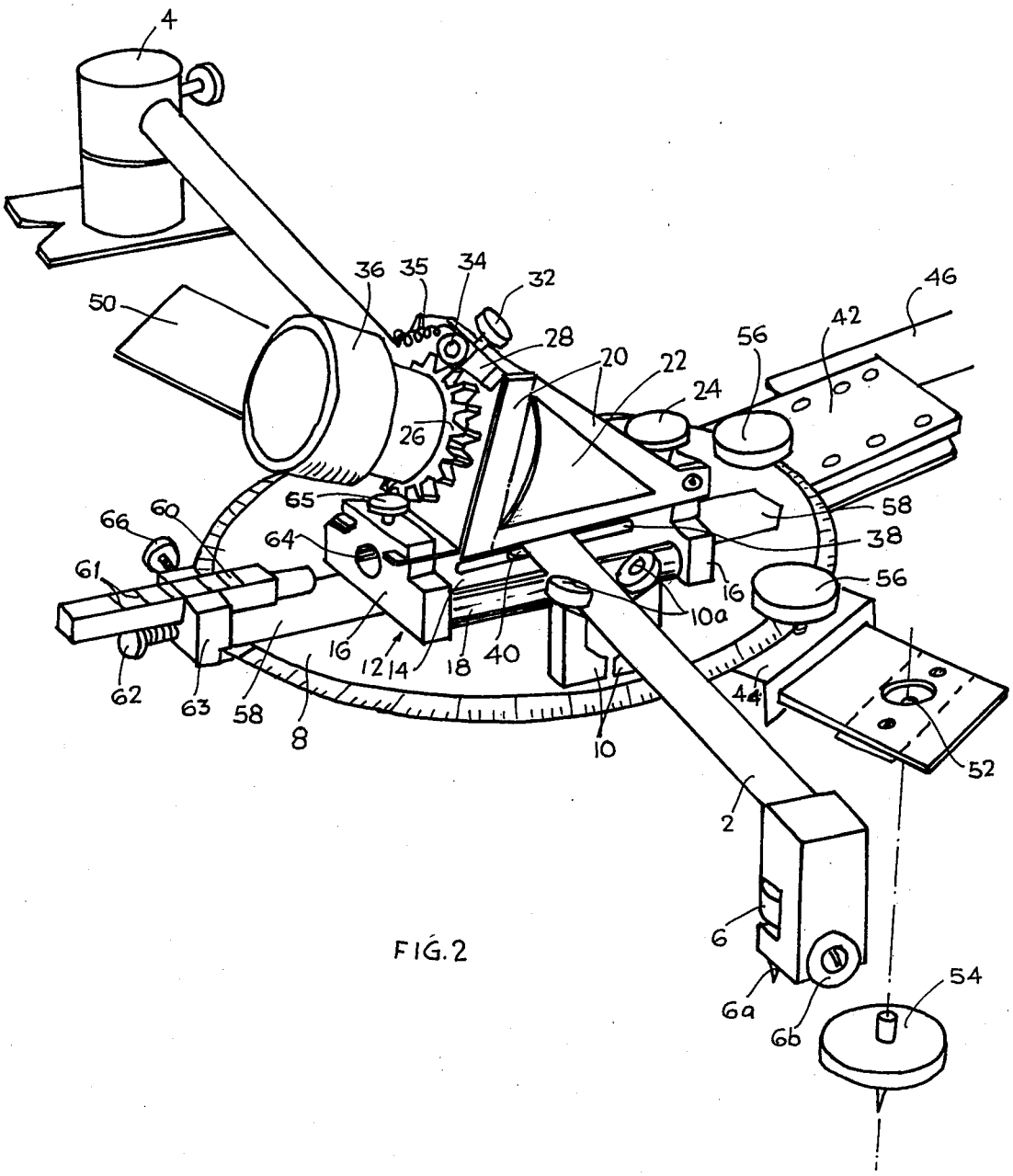
FIG. 2 shows a perspective view of the drawing instrument shown in FIG. 1 from another side thereof.
Figure 3:
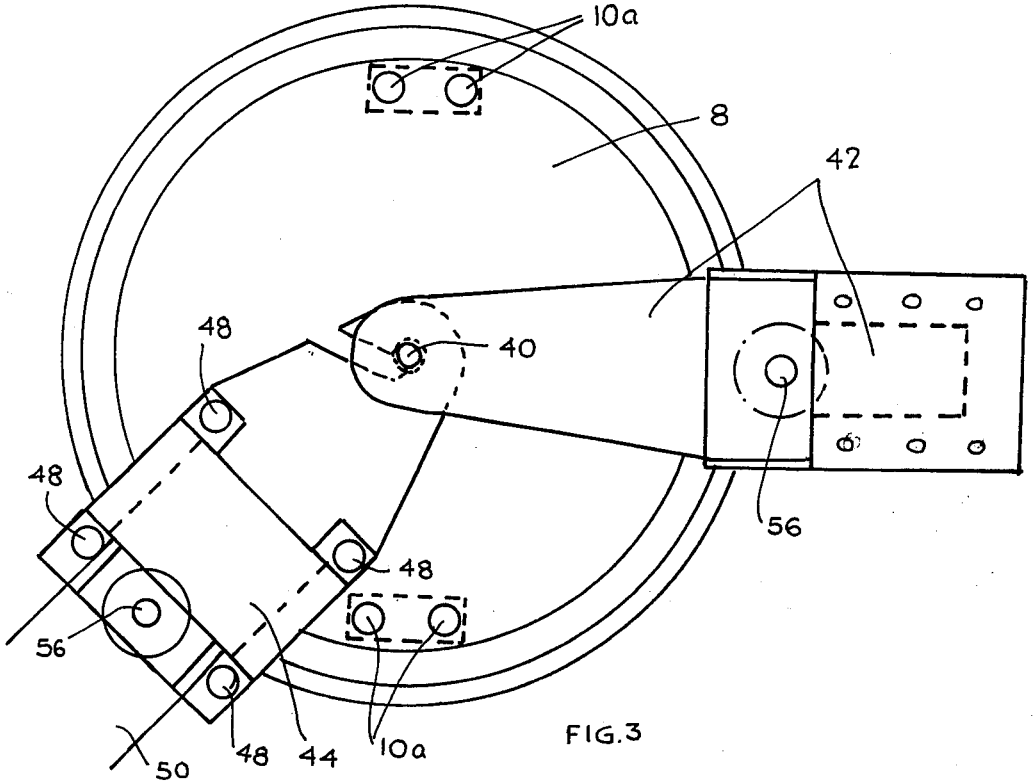
FIG. 3 shows a bottom plan view of the slide disc seen in FIGS. 1 and 2.

On the underside of the slide disc 8 and rotatably connected to the center thereof (see FIG. 3) are provided a horizontally-disposed arm 42 and an additional horizontally-disposed radial arm 44. As shown in FIG. 3, the radial arm 42 is connectable to a foot ruler 46 and the additional radial arm 44 is provided with roller abutments 48 which serve to slidably locate a slidng ruler 50. As shown, in FIGS. 1 and 2, the sliding ruler 50 carries a pin hole 52 in which can be located a pin 54. Each of the radial arms 42 and 44 are provided with a clamping screw 56 which serves to clamp the radial arm to any selected angular position on the slide disc 8. For the purpose of determining the angular setting of the carriage 12, a pointer 58 is fixedly mounted below said carriage so that when the carriage is turned relative to the slide disc 8 the setting of the pointer on the graduations of the slide disc serves to indicate the angular setting. The carriage is also provided with an index rod 60, which carries transverse slots 61 which are precalibrated in terms of the spacing required between two lines, which spacing is determined by the position of the conical member on the guide rod. As would be obvious, the sapcing between two lines obtained, as explained hereinbelow, by turning the conical member through the tooth of the toothed wheel 26, will be wide if the thicker part of the conical member is in contact with the guide rod and small if the narrow part of the conical member is in contact with said guide rod. The index rod is mounted horizontally at the periphery of the slide disc on a shoulder 63 whereat it can be clamped by means of a clamping screw 62, with one end thereof located in an aperture 64 provided in one of the upright shoulders 16 and clamped in said aperture by a screw 65 of the carriage 12 and the other end thereof clamped in position by the clamping screw 66 which engages any slot 61 selected for producing lines with a selected opening.

The multi-purpose drawing instrument can be employed for drawing equidistant lines, increasing or decreasing shade lines, vanishing lines or vanishing lines in perspective.

Figure 9:
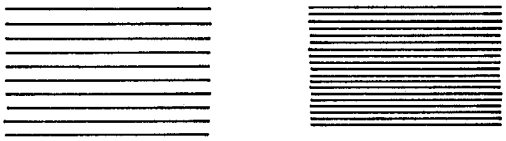
FIG. 9 shows different patterns of equidistant lines generated by the drawing instrument.

To draw equidistant lines, the instrument is set as shown in FIG. 5. To obtain this setting, the clamping screws 24 and 66 (FIGS. 1 and 2) are loosened and the carriage 12 moved transversely of said guide rod to a setting determined by the lines spacing required which is determined by the slots 61 on index rod 60. The clamping screws 24 and 66 are then clamped so that guide rod 2 is held in pressure contact between said conical member and the roller rods 18. The entire carriage 12 is then turned to lie transversely (i.e. 90°) of the guide rod 2, as indicated by the pointer 58. In this setting, the foot-ruler 46 is disposed normally to the guide rod 2. The knurled head 36 is then turned to move the conical member through a distance equal to the gap between two adjacent teeth of the toothed wheel; the release mechanism is, of course, kept in active position. Since the conical member 22 is in pressure engagement with the guide rod 2, the entire carriage along with the slide disc 8 moves along the guide rod by an equivalent distance. This operation is repeated and for each operation, lines 68 are drawn with the foot-ruler 46. For drawing lines with larger separations, the position of the conical member is set by first setting the position of the index rod 60 and then adjusting the position of the conical member transversely of said guide rod till the aperture 64 (FIG. 2) abuts the index rod. Examples of equidistant lines 68 drawn with the assistance of this drawing instrument are shown in FIG. 9.

Figure 10:
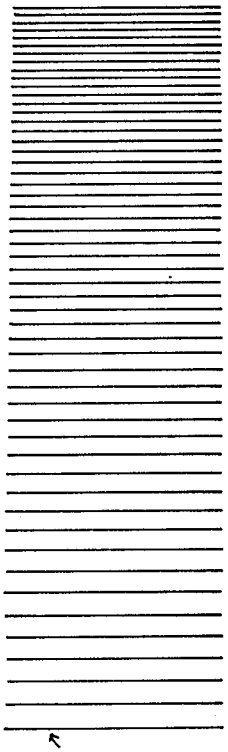
FIG. 10 shows different patterns of increasing and decreasing shade lines generated by the drawing instrument.

For drawing increasing or decreasing shade lines, the drawing instrument is set as shown in FIG. 6. This setting is identical to that shown in FIG. 5 except that the carriage 12 is turned through a predetermined angle relative to the normal position shown in FIG. 5 and screw 66 is released to allow the entire carriage and the index rod to move horizontally. In this case, when the knurled head 36 is operated, lines 70 with increasing or decreasing gaps are obtained; see also FIG. 10.

Figure 11:
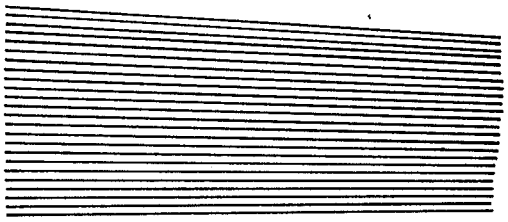
FIG. 11 shows vanishing lines generated by the drawing instrument.

For drawing vanishing lines, the instrument is set as shown in FIG. 7. In this case, both the radial arms 42 and 44 are employed and the carriage is mounted at an angle of 90° relative to the guide rod as shown also in FIG. 5. The two radial arms 44 and 46 are also kept at a predetermined acute angle with respect to each other. To draw the vanishing lines 72, the pin 6*a* (FIG. 2) is withdrawn so that the guide rod can turn about the fixed end support 4 (corresponding point in FIG. 8 is A); also pin 54 is inserted in the pin hole 52 (FIG. 2) so that the free end of the ruler 50 whereat the pin is located is firmly fixed (corresponding point in FIG. 8 is C). When, with one end support 4 fixed and the other movable, the knurled head is operated in steps, the carriage moves along the guide rod and simultaneously the guide rod swings about its fixed end 4. In other words, referring to FIG. 8 also, the movement is such that ∠ABC and ∠AEC always remain equal with ∠ABC remaining constant. Vanishing lines 72 (see also FIG. 11) are then obtained by drawing lines against the ruler 46.

To produce vanishing lines in perspective, the instrument is set as shown in FIG. 7 but with the carriage arranged at a predetermined angle to the vertical setting, as shown in FIG. 6, and the operation followed for drawing vanishing lines repeated. FIGS. 12 and 13 illustrate vanishing lines in perspective obtained with the assistance of this instrument.

I claim:

1. A multi-purpose drawing instrument comprising a guide rod supported horizontally on upright end supports; a slide disc including roller support means which slidingly engage said guide rod so that the disc is slidable along said guide rod; a carriage slidingly supported on said guide rod above said slide disc, a conical member, means rotatably supporting said conical member on said slide disc with the side wall of the conical member in pressure contact with the guide rod so that when said conical member is turned the carriage moves along the guide rod, tightening means on said carriage for varying the contact pressure of the conical member on the guide rod; adjustment means for adjusting the position of the carriage transversely of said guide rod and for engaging the carriage with the slide disc when said carriage or slide disc is moved along the guide rod; a horizontally-disposed radial arm one end of which is rotatably connected to the center of the slide disc so that it can be rotated thereat and the free end of which is connectable to a foot ruler, and clamping means for clamping said horizontally disposed radial arm to said slide disc at any desired angle relative to the guide rod or said carriage.

2. A drawing instrument as claimed in claim 1, wherein said conical member includes a manually operable toothed wheel at one end thereof and said carriage is provided with an abutment means which engages the toothed wheel so that when said conical member is turned through a distance equal to that between two adjacent teeth the carriage travels along said guide rod by an identical distance.

3. A drawing instrument as claimed in claim 2, wherein said abutment means is adjustably mounted on the carriage and a release mechanism is provided in the vicinity thereof on the carriage for moving said abutment means to engage or disengage the toothed wheel.

4. A drawing instrument as claimed in claim 2 comprising a knurled head on said toothed wheel on the side thereof remote from said conical member for facilitating the operation of said conical member.

5. A drawing instrument as claimed in claim 2 wherein said slide disc is located below said guide rod and wherein said carriage comprises a base plate disposed over said slide disc; a pair of oppositely disposed upright shoulders mounted on said base plate and connected by a pair of roller rods disposed below and substantially transversely of said guide rod, said roller rods being in pressure contact with said guide rod; and an enclosure supported on said pair of upright shoulders for housing said conical member and for supporting said toothed wheel, said enclosure being disposed above said guide rod and having an open base to allow the side wall of said conical member to press against said guide rod.

6. A drawing instrument as claimed in claim 5, in which said tightening means comprises at least one screw provided at one end of said enclosure, which screw engages in a corresponding aperture provided in said oppositely disposed upright shoulder.

7. A drawing instrument as claimed in claim 5 wherein said adjustment means comprises an extended slot provided in said base plate and disposed transversely of said guide rod and an upright engagement lug located centrally in said slide disc and projecting within said extended slot so that said carriage can be moved transversely of said guide rod.

8. A drawing instrument as claimed in claim 5 comprising to a horizontally-disposed index rod adjustably mounted at the periphery of said slide disc with one end of said index rod abutting one of the said upright shoulders to enable the transverse position of said carriage relative to said guide rod to be set precisely.

9. A drawing instrument as claimed in claim 1 including an additional horizontally-disposed radial arm one end of which is rotatably connected to the center of the slide disc so that it can be rotated thereat and the other free end of which is provided with guide channels for slidably locating a ruler, clamping means being provided for clamping said additional radial arm to said slide disc at any desired angle relative to the guide rod or said carriage.

10. A drawing instrument as claimed in claim 9, in which the slide ruler locatable in the other end of the additional radial arm is provided with a pin-hole.

11. A drawing instrument as claimed in claim 1, wherein said slide disc is a protractor, a pointer being mounted between said disc and said carrier so as to indicate the angular position of the carriage relative to the guide rod.

12. A drawing instrument as claimed in claim 1 wherein one of said upright end supports is provided with at least one of a supporting pin and roller bearings.

* * * * *